US010921750B2

(12) United States Patent
Okuno

(10) Patent No.: US 10,921,750 B2
(45) Date of Patent: Feb. 16, 2021

(54) IMAGE FORMING APPARATUS HAVING MONOCHROME AND COLOR PRINTING MODES

(71) Applicant: FUJI XEROX CO., LTD., Tokyo (JP)

(72) Inventor: Taichiro Okuno, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/725,594

(22) Filed: Dec. 23, 2019

(65) Prior Publication Data

US 2020/0310345 A1 Oct. 1, 2020

(30) Foreign Application Priority Data

Apr. 1, 2019 (JP) ..... JP2019-069576

(51) Int. Cl.
*G03G 21/20* (2006.01)
*G03G 15/16* (2006.01)
*G03G 15/06* (2006.01)

(52) U.S. Cl.
CPC ..... *G03G 21/203* (2013.01); *G03G 15/065* (2013.01); *G03G 15/1605* (2013.01)

(58) Field of Classification Search
CPC .... G03G 21/203; G03G 21/20; G03G 15/065; G03G 15/1605; G03G 15/5008; G03G 2215/0122; G03G 2215/019
See application file for complete search history.

(56) References Cited

U.S. PATENT DOCUMENTS

2016/0139531 A1* 5/2016 Shimazoe ..... G03G 15/0266 399/50
2018/0039212 A1* 2/2018 Tomine ..... G03G 15/0189

FOREIGN PATENT DOCUMENTS

JP 08-278679 A 10/1996
JP 2005-173228 A 6/2005

* cited by examiner

*Primary Examiner* — Sandra Brase
(74) *Attorney, Agent, or Firm* — Sughrue Mion, PLLC

(57) ABSTRACT

An image forming apparatus includes: a plurality of image holding units that include first and second image holding units and on which toner images are formed through developing while the image holding units rotate; a plurality of developing units that respectively face the plurality of image holding units and develop an electrostatic latent image on each of the plurality of image holding units with toner under a developing bias voltage applied to each developing unit; a power supply unit that applies a developing bias voltage to the plurality of developing units, and is common to the plurality of image holding units; an intermediate transfer unit that receives transfer of a toner image from the plurality of image holding units and transfers the toner image to a transfer receiver while circulating in a circulation path including a moving path along the plurality of image holding units, the intermediate transfer unit having first and second modes, wherein in the first mode, the intermediate transfer unit receives transfer of a toner image from the plurality of image holding units, and in the second mode, the intermediate transfer unit is separated from the second image holding unit other than the first image holding unit and receives transfer of a toner image from the first image holding unit; and a driving unit that drives rotation of the plurality of image holding units, wherein in the second mode, the driving unit drives the second image holding unit so as to temporally change a position at which the second image holding unit faces the developing unit.

6 Claims, 9 Drawing Sheets

FIG. 9A

| DISTANCE d | $0 \leq d < D1$ | $D1 < d \leq D2$ | $D2 < d$ |
|---|---|---|---|
| SPEED | a mm/sec. | b mm/sec. | c mm/sec. |

$(a < b < c)$

FIG. 9B

| DISTANCE d | $0 \leq d < D1$ | $D1 < d \leq D2$ | $D2 < d$ |
|---|---|---|---|
| TIME INTERVAL | A sec. | B sec. | C sec. |

$(A > B > C)$

IMAGE FORMING APPARATUS HAVING MONOCHROME AND COLOR PRINTING MODES

CROSS-REFERENCE TO RELATED APPLICATIONS

This application is based on and claims priority under 35 USC 119 from Japanese Patent Application No. 2019-069576 filed Apr. 1, 2019.

BACKGROUND

(i) Technical Field

The present disclosure relates to an image forming apparatus.

(ii) Related Art

One of known image forming apparatuses is what is called a tandem type. Such a tandem type image forming apparatus includes plural image holding units and plural developing units that respectively face the plural image holding units and develop an electrostatic latent image on each of the plural image holding units with toner. The electrostatic latent images on the plural image holding units are firstly transferred onto an intermediate transfer belt and secondarily transferred onto paper.

One of tandem type image forming apparatuses is configured to switch between a color image forming mode and a monochrome image forming mode. Such a mode switching type image forming apparatus has measures to prevent degradation of an image holding or developing unit not in use, in which in the monochrome image forming mode, an intermediate transfer belt is separated from image holding units other than the image holding unit for forming a toner image of K color (black).

To develop the electrostatic latent image on the image holding unit, a developing bias voltage is applied to the developing unit. In the related art, separate power supply units are often used to apply developing bias voltages respectively to the unit for developing with the K color (black) toner and other units for developing with toner of other colors.

In this regard, for cost reduction, only one common power supply unit may be provided to apply developing bias voltages.

JP-A-08-278679 proposes that only one common power supply unit is provided together with a switch for mode-dependent switching between application and no application of developing bias voltages.

In addition, JP-A-2005-173228 proposes that two power supply units are provided and that in the monochrome image forming mode, developing units not in use, except for the unit for developing with the K color (black) toner, are slowly or intermittently driven in order to prevent sticking of the toner in the developing unit.

If an image holding unit is stopped while a developing bias voltage is applied to the developing unit, particularly, in a high-temperature, high-humidity environment, an area of the image holding unit facing the developing unit may be charged under the influence of the developing bias, so that streaks may occur as defects on the image.

SUMMARY

Aspects of non-limiting embodiments of the present disclosure relate to providing an image forming apparatus that has only one power supply unit and can prevent such defects on images without any additional component for preventing the defects on images.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided an image forming apparatus including: plural image holding units that include first and second image holding units and on which toner images are formed through developing while the image holding units rotate; plural developing units that respectively face the plural image holding units and develop an electrostatic latent image on each of the plural image holding units with toner under a developing bias voltage applied to each developing unit; a power supply unit that applies a developing bias voltage to the plural developing units, and is common to the plural image holding units; an intermediate transfer unit that receives transfer of a toner image from the plural image holding units and transfers the toner image to a transfer receiver while circulating in a circulation path including a moving path along the plural image holding units, the intermediate transfer unit having first and second modes, wherein in the first mode, the intermediate transfer unit receives transfer of a toner image from the plural image holding units, and in the second mode, the intermediate transfer unit is separated from the second image holding unit other than the first image holding unit and receives transfer of a toner image from the first image holding unit; and a driving unit that drives rotation of the plural image holding units, wherein in the second mode, the driving unit drives the second image holding unit so as to temporally change a position at which the second image holding unit faces the developing unit.

BRIEF DESCRIPTION OF THE DRAWINGS

Exemplary embodiments of the present invention will be described in detail based on the following figures, wherein:

FIGS. 9A and 9B are diagrams illustrating control according to an environmental distance.

DETAILED DESCRIPTION

Hereinafter, exemplary embodiments according to the present disclosure will be described.

Figure 1:
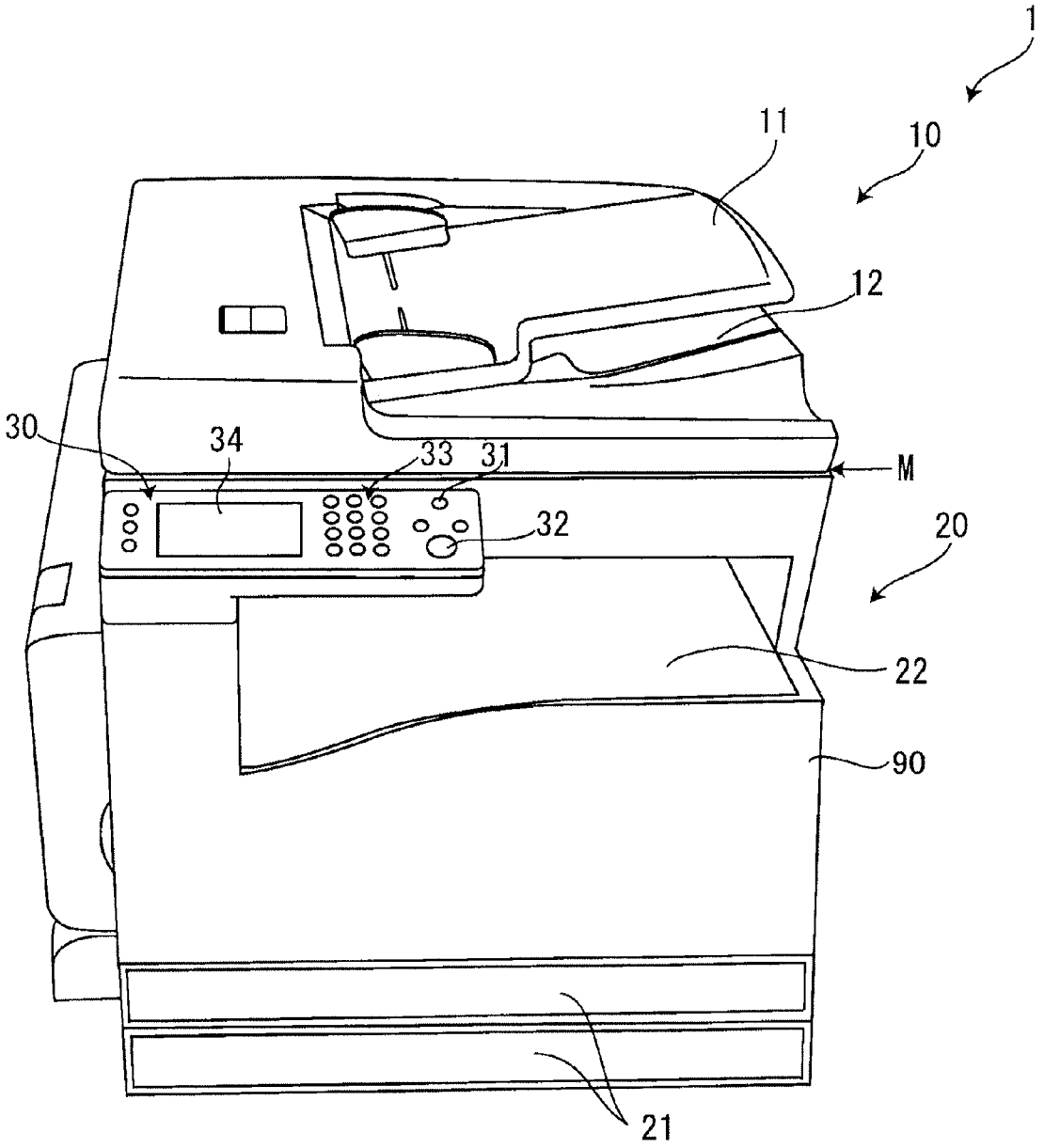
FIG. 1 is an external perspective view of an image forming apparatus as a first exemplary embodiment of the present disclosure.

FIG. 1 is an external perspective view of an image forming apparatus as a first exemplary embodiment of the present disclosure;

The image forming apparatus 1 includes an apparatus casing 90, and includes a scanner 10 placed on the apparatus casing 90 and a printer 20 configured in the apparatus casing 90.

The scanner 10 is an apparatus which reads an image drawn on a document and generates an image signal. The printer 20 is an apparatus which prints out an image based on an image signal on paper by a so-called electrophotographic process.

The scanner 10 includes a document tray 11 and a document output tray 12. When a start button 32 is pressed in a state of documents being stacked on the document tray 11, the documents are sequentially fed and read one by one and discharged onto the document output tray 12. In addition, the scanner 10 is provided with a hinge (not illustrated) extending left and right on a back side, and a portion above the arrow M can be lifted and opened. A transparent glass plate 13 (see FIG. 2) extends immediately below the arrow M. It is also possible to read a document on the transparent glass plate 13 by placing the one document on the transparent glass plate 13 downward, closing the portion above the arrow M, and pressing the start button 32.

In addition, the printer 20 is an apparatus which sequentially takes out pieces of paper stacked in a paper tray 21 one by one and prints an image based on an image signal on the taken-out paper. The paper on which the image is printed is discharged onto a paper output tray 22.

In addition, the image forming apparatus 1 includes a user interface (UI) 30. The UI 30 includes a power button 31, the start button 32, plural other push buttons 33, and a touch panel type display screen 34. By operating the UI 30, various instructions such as an instruction for the number of prints and an instruction for starting an operation are performed. The display screen 34 displays a state of the apparatus and various push buttons. The push button displayed on the display screen 34 is also an operation target.

Figure 2:
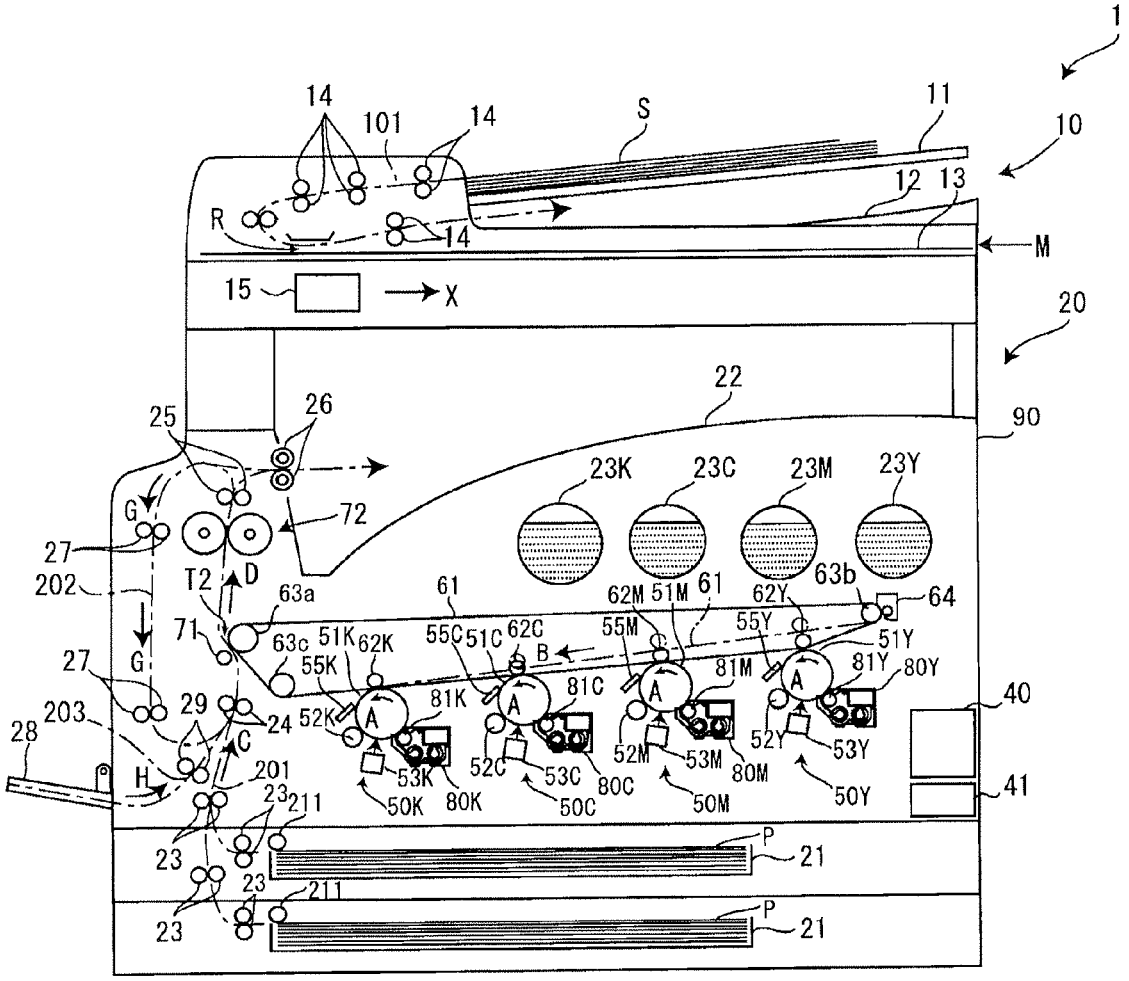
FIG. 2 is a schematic diagram illustrating an internal configuration of the image forming apparatus having an appearance illustrated in FIG. 1.

FIG. 2 is a schematic diagram illustrating an internal configuration of the image forming apparatus having an appearance illustrated in FIG. 1.

When the start button 32 (see FIG. 1) is pressed, documents S placed on the document tray 11 of the scanner 10 are fed one by one and are transported on a transport path 101 by a transport roller 14, and passes through a reading position R in contact with the transparent glass plate 13 in the middle of the transport and is discharged onto the document output tray 12. When the document S passes through the reading position R, an image recorded on the document S is read and converted into an image signal by a reading device 15 which is stationary facing the reading position R.

In addition, the portion above the arrow M is opened, one document is placed on the transparent glass plate 13 downward and the upper portion is closed, and the start button 32 is pressed. Then, the reading device 15 reads the document on the transparent glass plate 13 while moving in an arrow X direction, and converts an image of the document into an image signal.

In addition, the printer 20 includes four image forming units 50Y, 50M, 50C, and 50K approximately horizontally arranged in a row. In these image forming units 50Y, 50M, 50C, and 50K, toner images are respectively formed with color toners of yellow (Y), magenta (M), cyan (C), and black (K). Here, for description common to these image forming units 50Y, 50M, 50C, and 50K, the symbols of Y, M, C, and K, which indicate distinction of the toner colors, are omitted, and denoted as an image forming unit 50. The same applies to other components other than the image forming unit.

Each image forming unit 50 includes an image holder 51. The image holder 51 receives a driving force and rotates in a direction of the arrow A to form an electrostatic latent image on a surface of the image holder 51, and further, a toner image is formed by development.

Around each image holder 51 in each image forming unit 50, a charger 52, an exposure device 53, a developing device 80, a first transfer device 62, and a cleaner 55 are included. Here, the first transfer device 62 is disposed at a position between the image holder 51 and an intermediate transfer belt 61 to be described below.

The charger 52 uniformly charges a surface of the image holder 51.

The exposure device 53 irradiates the uniformly charged image holder 51 with exposure light modulated based on an image signal, and an electrostatic latent image is formed on the image holder 51.

The developing device 80 develops the electrostatic latent image formed on the image holder 51 with toner of a color corresponding to each of the image forming units 50Y, 50M, 50C, and 50K so as to form a toner image on the image holder 51. Specifically, the developing device 80 accommodates a developer by toner and carrier. The developing device 80 includes a developing roll 81 at a position facing the image holder 51. A developing bias is applied to the developing roll 81 by a developing bias power supply 44 (not illustrated) (see FIG. 3). The developer in the developing device 80 is conveyed to a position facing the image holder 51 by the developing roll 81, and the electrostatic latent image formed on the image holder 51 is developed with toner in the developer under the action of the developing bias applied to the developing roll 81.

Here, the image holder 51 corresponds to an example of an image holding unit referred to in the present disclosure, and the developing device 80 or the developing roll 81 constituting the developing device 80 is an example of a developing unit referred to in the present disclosure. In addition, the developing bias power supply 44 corresponds to an example of a power supply unit referred to in the present disclosure. The developing bias power supply 44 is a power supply provided in common to the four image forming units 50Y, 50M, 50C, and 50K.

The first transfer device 62 transfers the toner image formed on the image holder 51 onto the intermediate transfer belt 61 to be described below.

The cleaner 55 includes a blade, and the blade is pressed against the image holder 51, and scrapes residual toner or the like attached to the image holder 51 after the transfer from the image holder 51.

The intermediate transfer belt 61 is provided above the four image forming units 50. The intermediate transfer belt 61 is supported by plural rolls 63*a*, 63*b*, and 63*c*. The intermediate transfer belt 61 circulates in a direction of the arrow B on a circulation path including a path along the four image holders 51 in the four image forming units 50.

A toner image on each image holder 51 is transferred so as to sequentially overlap with the intermediate transfer belt 61 by an action of the first transfer device 62. The toner image transferred onto the intermediate transfer belt 61 is transported to a secondary transfer position T2 by the intermediate transfer belt 61.

A secondary transfer device 71 is provided at the secondary transfer position T2. The secondary transfer device 71 is in contact with a second surface, which is a back surface to a first surface facing the intermediate transfer belt 61 side, of paper P transported to the secondary transfer position T2, receives application of a transfer voltage, and has a function of drawing the toner image on the intermediate transfer belt 61 toward the paper P side and transferring the toner image onto the paper P.

The toner or the like remaining on the intermediate transfer belt 61 after the transfer of the toner image onto the paper P is removed from the intermediate transfer belt 61 by an intermediate transfer belt cleaner 64.

Here, the printer 20 includes a monochrome mode in which only the image forming unit 50K, which forms a toner image with toner of black color (K), positioned at one end (the leftmost end in FIG. 2) of the arrangement prints a monochrome image on the paper P and a color mode in which a color image is printed on the paper P by using the four image forming units 50Y, 50M, 50C, and 50K. By a cam mechanism (not illustrated), the intermediate transfer belt 61 moves while being in contact with the four image holders 51 constituting the four image forming units 50Y, 50M, 50C, and 50K in a case of the color mode, and a circulation moving path of the intermediate transfer belt 61 is changed so that the intermediate transfer belt 61 is in contact with only the image holder 51K of the image forming unit 50K positioned at one end (the leftmost end in FIG. 2) of the arrangement and separated from image holders 51Y, 51M, and 51C of all the other the image forming units 50Y, 50M, and 50C in a case of the monochrome mode.

Here, the intermediate transfer belt 61 corresponds to an example of an intermediate transfer unit referred to in the present disclosure. In addition, the color mode corresponds to an example of a first mode referred to in the present disclosure, and the monochrome mode corresponds to an example of a second mode referred to in the present disclosure. Further, among the four image holders 51Y, 51M, 51C, and 51K, the image holder 51K having a function of forming a monochrome image corresponds to an example of a first image holding unit referred to in the present disclosure, and the other three image holders 51Y, 51M, and 51C correspond to an example of a second image holding unit referred to in the present disclosure.

A toner cartridge 23 which accommodates toner of each color is provided above the intermediate transfer belt 61. When toner in the developing device 80 is consumed by development, toner is supplied to the developing device 80 from the toner cartridge 23 which accommodates toner of the corresponding color through a toner supply path (not illustrated). The toner cartridge 23 is configured to be detachable, and when the toner cartridge 23 is empty, the toner cartridge 23 is taken out and a new toner cartridge 23 is mounted.

In addition, two paper trays 21 are provided below the printer 20. The paper P before printing in a state of being stacked is accommodated in each paper tray 21. These paper trays 21 are configured to be freely drawn out for replenishment or replacement of paper.

One paper tray out of the two paper trays 21 is designated for image-forming. One sheet of paper P is taken out from the paper tray 21 designated for image-forming by a pickup roll 211, and is transported up to a timing adjustment roll 24 in a direction of the arrow C on a transport path 201, by a transport roller 23. The paper P transported to the timing adjustment roll 24 is transmitted out toward the secondary transfer position so that the paper P reaches the secondary transfer position T2 in accordance with a timing at which a toner image on the intermediate transfer belt 61 reaches the secondary transfer position T2, by the timing adjustment roll 24. The paper P transmitted out by the timing adjustment roll 24 receives the transfer of the toner image from the intermediate transfer belt 61 by an action of the secondary transfer device 71 at the secondary transfer position T2. The paper P receiving the transfer of the toner image is further transported in a direction of the arrow D and passes through a fixing machine 72. The toner image on the paper P is fixed on the paper P by being heated and pressurized by the fixing machine 72. Accordingly, an image from the fixed toner image is formed on the paper P. The paper on which the toner image is fixed by the fixing machine 72 is further transported by a transport roller 25 and is transmitted out onto the paper output tray 22 by an output roll 26.

In addition, the printer 20 includes a double-sided mode in which images are printed on both surfaces of the paper P. In the same manner, in the double-sided mode, after an image is printed on the first surface of the paper P, the paper P having the first surface on which the image is printed is transmitted out halfway toward the paper output tray 22, by the output roll 26. The output roll 26 reverses a rotation direction and draws back the paper P transmitted out halfway onto the paper output tray 22.

The paper P drawn back by the reversal of the output roll 26 is transported on a transport path 202 in a direction indicated by the arrow G by a transport roller 27 and reaches the timing adjustment roll 24 again. At this time, the paper P is in a state in which an inside and an outside are reversed from when the image is printed on the first surface. After reaching the timing adjustment roll 24 again, an image is printed on the second surface of the paper P at this time, in the same manner described above. The paper P on which images are printed on both surfaces in this manner is transmitted out onto the paper output tray 22 by the output roll 26 this time.

In addition, a manual feed tray 28 is provided in the printer 20. When paper is placed on the manual feed tray 28 and the start button 32 is pressed, the paper on the manual feed tray 28 is transported on a transport path 203 in a direction of the arrow H by a transport roller 29 and reaches the timing adjustment roll 24. The subsequent printing operation is the same as the printing operation on the paper P drawn from the paper tray 21.

In addition, the image forming apparatus 1 includes a control unit 40 which controls each unit, and each unit of the image forming apparatus 1 is controlled by the control unit 40.

Further, the image forming apparatus 1 includes an environmental sensor 41 which measures temperature and humidity in the apparatus. A measured value of temperature and humidity by the environmental sensor 41 is transmitted to the control unit 40. The control unit 40 performs various controls based on also the temperature and humidity.

Figure 3:
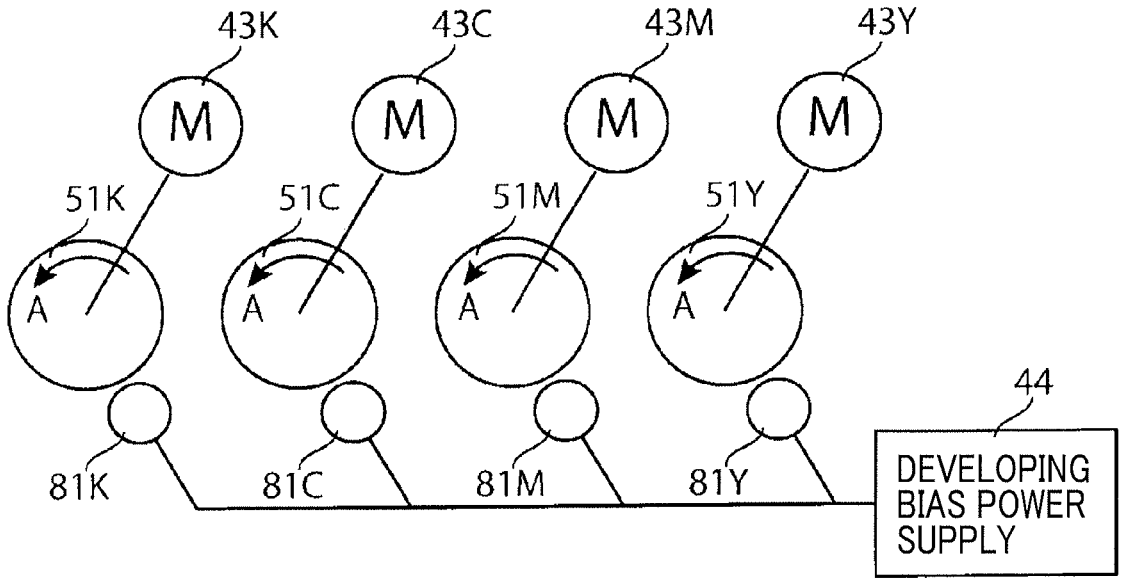
FIG. 3 is a schematic diagram illustrating a characteristic portion of an image forming apparatus according to the present exemplary embodiment illustrated in FIGS. 1 and 2.

FIG. 3 is a schematic diagram illustrating a characteristic portion of an image forming apparatus 1 according to the present exemplary embodiment illustrated in FIGS. 1 and 2.

FIG. 3 illustrates the four image holders 51Y, 51M, 51C, and 51K, four motors 43Y, 43M, 43C, and 43K which respectively drive the image holders 51Y, 51M, 51C, and 51K, developing rolls 81Y, 81M, 81C, and 81K which are elements of developing devices 80Y, 80M, 80C, and 80K which develop electrostatic latent images on the respective image holders 51Y, 51M, 51C, and 51K with toner, and the developing bias power supply 44 which applies a developing bias to the respective developing rolls 81Y, 81M, 81C, and 81K. In order to reduce costs, only one developing bias power supply 44 is provided in common to the four developing rolls 81Y, 81M, 81C, and 81K. In addition, any switch for turning on or off the application of the developing bias is not provided between the developing bias power supply 44 and the four developing rolls 81Y, 81M, 81C, and 81K. A driving force transmission mechanism between each of the motors 43Y, 43M, 43C, and 43K and each of the image holders 51Y, 51M, 51C, and 51K is not illustrated.

Here, as described with reference to FIG. 2, the image forming apparatus 1 has the color mode and the monochrome mode. In the color mode, all of the four image holders 51Y, 51M, 51C, and 51K are rotated, and toner images of the colors Y, M, C, and K are formed respectively on the image holders 51Y, 51M, 51C, and 51K, and finally, a color image is formed on paper. On the other hand, in the monochrome mode, among the four image holders 51Y, 51M, 51C, and 51K, the intermediate transfer belt 61 is separated from the three image holders 51Y, 51M, and 51C, except for the image holder 51K, and a monochromatic image of K color is formed only by the image holder 51K.

In the related art, a developing bias power supply for applying a developing bias to the developing roll 81K for K color and a developing bias power supply for three colors of Y, M, and C other than K color are separately provided. In this case, in the monochrome mode, the developing bias power supply for three colors of Y, M, and C is controlled to be turned off, and a developing bias is not applied to the three developing rolls 81Y, 81M, and 81C other than the developing roll 81K.

On the other hand, in the exemplary embodiment illustrated in FIG. 3, there is only one developing bias power supply 44. Therefore, even in the monochrome mode, the developing bias power supply 44 remains on because a developing bias needs to be applied to the developing roll 81K. This means that a developing bias remains applied also to the three developing rolls 81Y, 81M, and 81C other than the developing roll 81K. As illustrated in FIG. 3, a slight gap exists between the image holder 51 and the developing roll 81. Meanwhile, a developer (not illustrated) exists in the gap, and the image holder 51 and the developing roll 81 are approximately in contact with each other via the developer. Therefore, the developing bias also remains applied to the three developing rolls 81Y, 81M, and 81C other than the developing roll 81K. On the other hand, when the operation of the three image holders 51Y, 51M, and 51C is stopped, areas of the image holders 51Y, 51M, and 51C facing the developing rolls 81Y, 81M, and 81C remain affected by the developing bias. When the color mode, in which toner images are also formed on the three image holders 51Y, 51M, and 51C, is used again after the monochrome mode, charging the image holders 51Y, 51M, and 51C by the chargers 52Y, 52M, and 52C cannot immediately eliminate the influence of the developing bias, which may cause stripe-shaped defects different in color from the surrounding part, called color streaks, to appear on the formed image.

Hereinafter, conditions under which such color streaks appear will be described with reference to test data.

Figure 4:
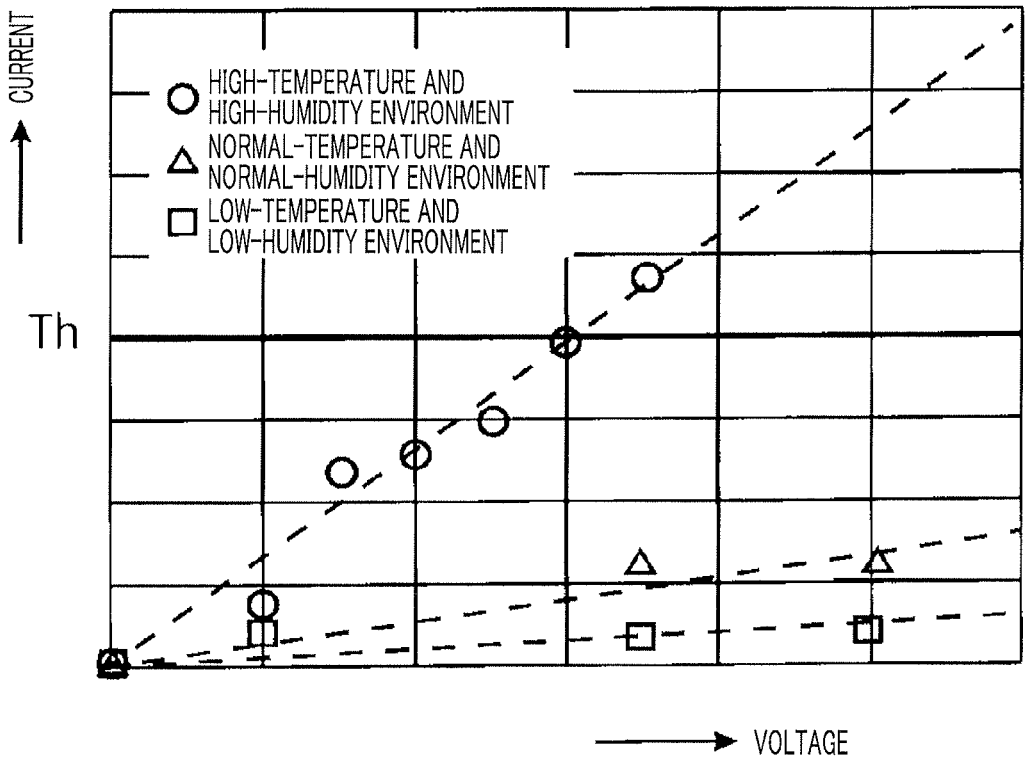
FIG. 4 is a graph illustrating the relationship between developing bias voltage and current value flowing through a developing roll and an image holder.

FIG. 4 is a graph illustrating the relationship between developing bias voltage and current value flowing through a developing roll and an image holder; In FIG. 4, the horizontal axis represents developing bias voltage, and the vertical axis represents current.

Figure 5:
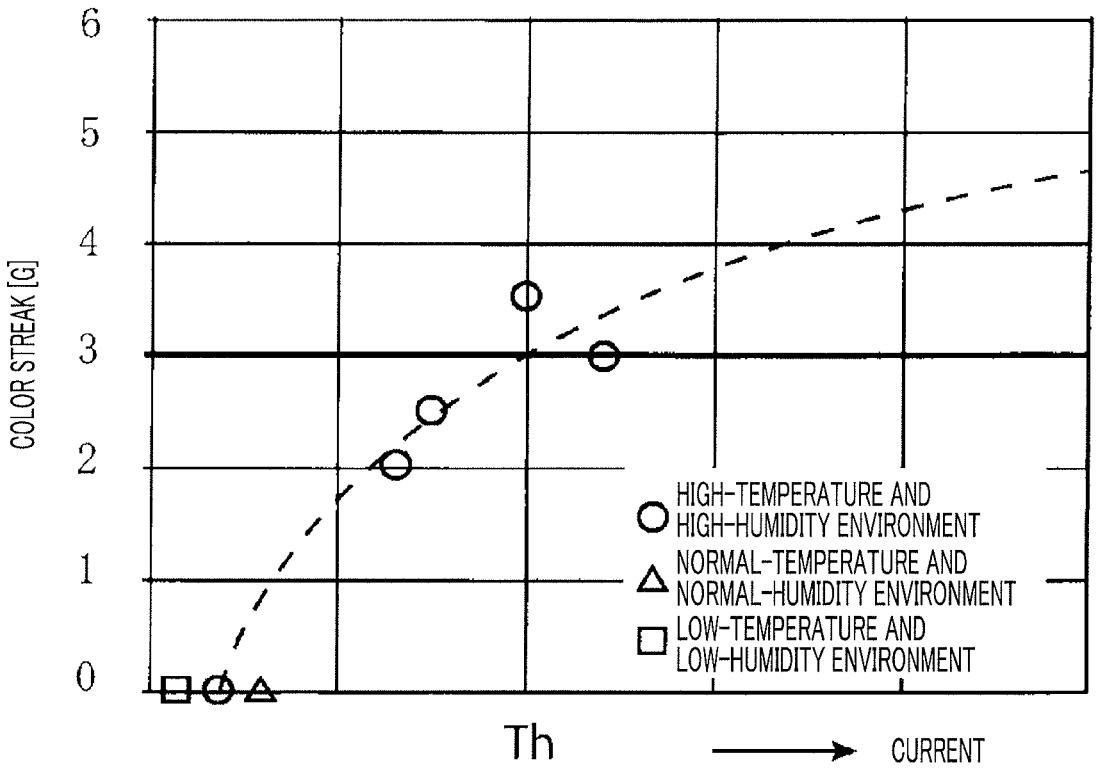
FIG. 5 is a graph illustrating the relationship between current and color streak obtained when a constant-value current is allowed to flow continuously for a certain period of time.

In this case, the relationship between voltage and current is shown for each of different environments including a high-temperature, high-humidity environment, a normal-temperature, normal-humidity environment, and a low-temperature, low-humidity environment. The current value is higher in the high-temperature, high-humidity environment. This means that the image holder 51 has a lower resistance value in the high-temperature, high-humidity environment. As illustrated in FIG. 5 below, when the current value exceeds a threshold value Th, color streaks may appear. This indicates that color streaks are more likely to appear in the high-temperature, high-humidity environment.

FIG. 5 is a graph illustrating the relationship between current and color streak obtained when a constant-value current is allowed to flow continuously for a certain period of time; In FIG. 5, the horizontal axis represents current, and the vertical axis represents color streak grade. The grade of color streaks is evaluated by human-eye observation. For color streaks, a grade of 3 is an acceptable limit, and a grade of more than 3 is unacceptable.

As shown in FIG. 5, color streaks at a level higher than the acceptable level are observed when a current exceeding the threshold value Th is allowed to flow continuously in the high-temperature, high-humidity environment.

Figure 6:
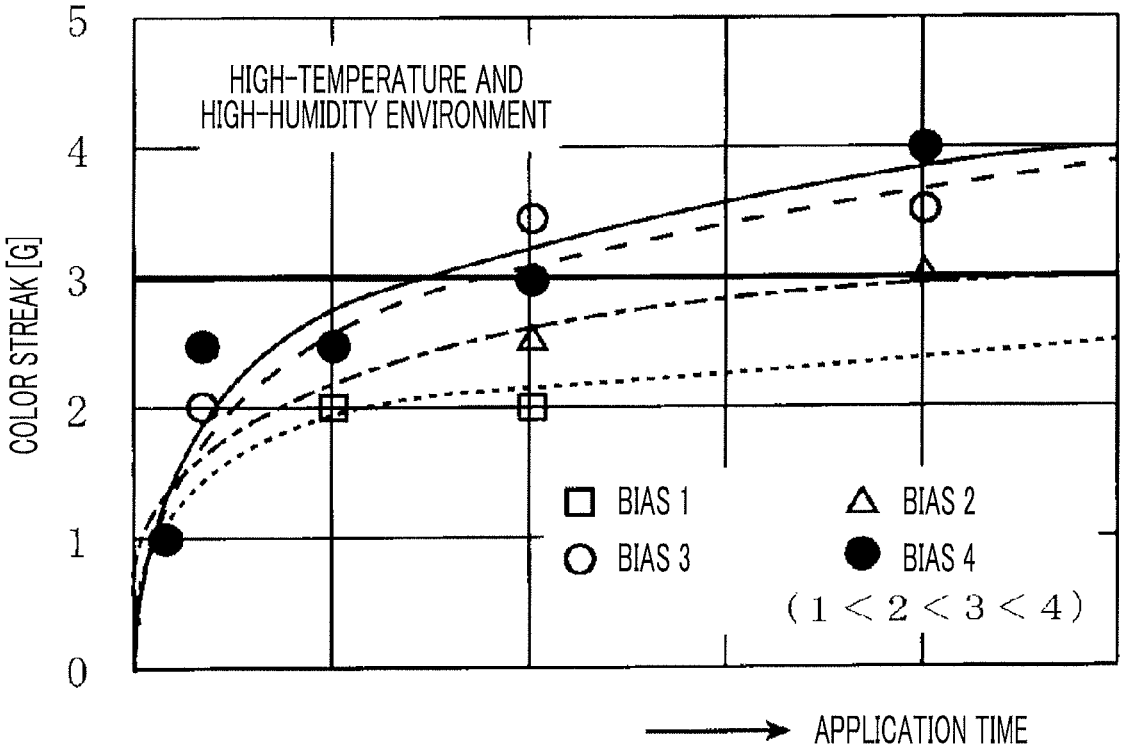
FIG. 6 is a graph illustrating the relationship between color streak and time for which a developing bias is applied in a high-temperature, high-humidity environment.

FIG. 6 is a graph illustrating the relationship between color streak and time for which a developing bias is applied in a high-temperature, high-humidity environment;

This indicates that higher-grade color streaks appear as the time for which the developing bias is applied increases and as the intensity of the applied developing bias increases.

Figure 7:
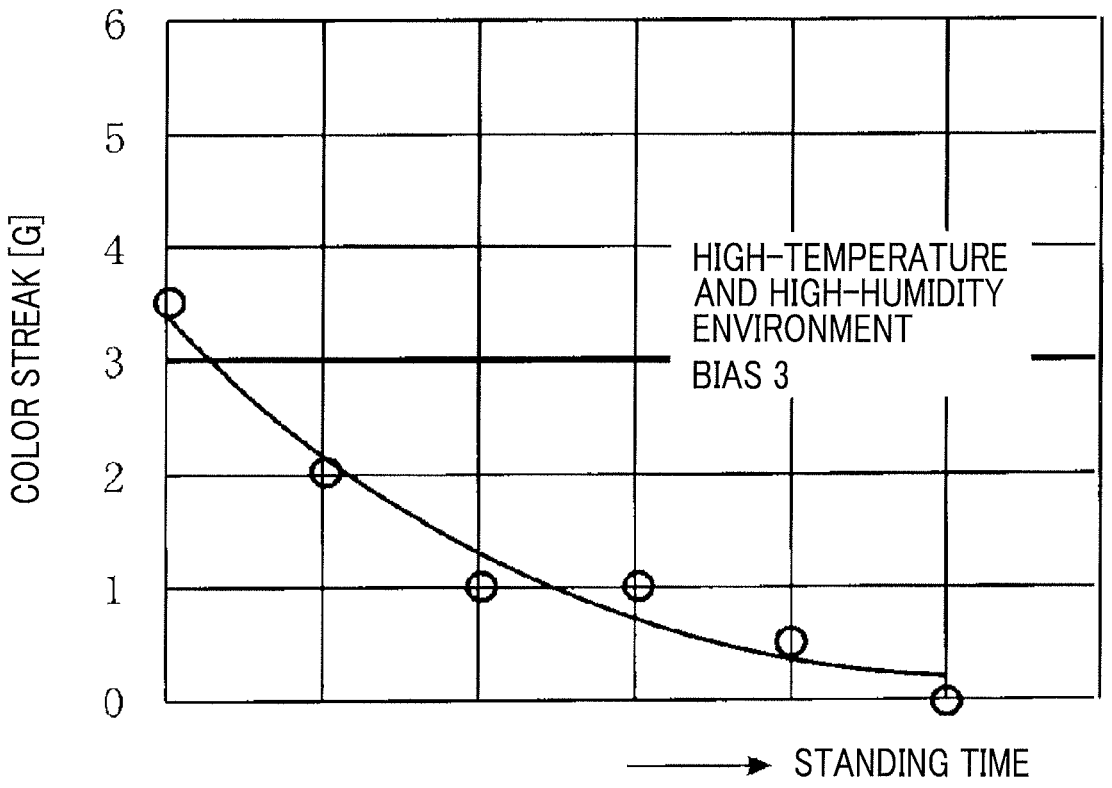
FIG. 7 is a graph illustrating the relationship between color streak and standing time after the stopping of the application of developing bias in the high-temperature, high-humidity environment.

FIG. 7 is a graph illustrating the relationship between color streak and standing time after the stopping of the application of developing bias in the high-temperature, high-humidity environment;

The graph indicates that even after the developing bias is applied at a level where color streaks exceeding the acceptable level can occur, the level of subsequent color streaks will decrease when the application of the developing bias is stopped.

Hereinafter, the technique according to the present exemplary embodiment for preventing color streaks will be described with reference to the results in FIGS. 4 to 7.

Figure 8:
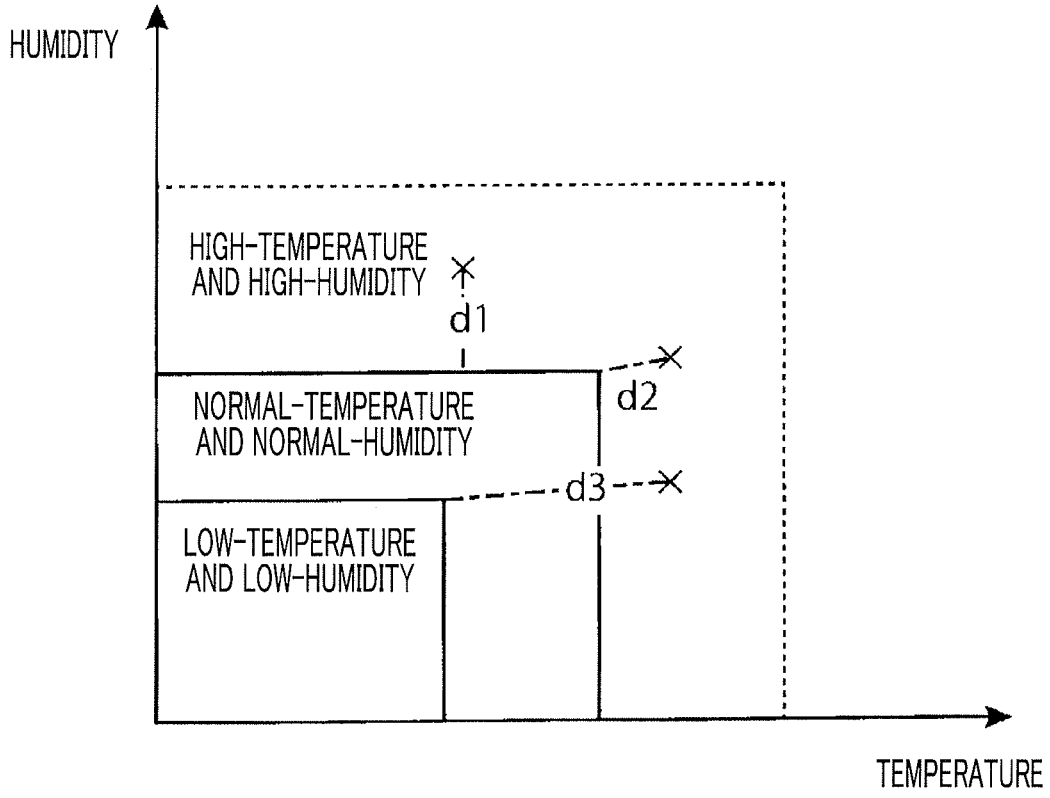
FIG. 8 is a diagram illustrating an area of environmental temperature and humidity measured by an environmental sensor.

FIG. 8 is a diagram illustrating environmental temperature-humidity areas measurable with an environmental sensor. In FIG. 8, the horizontal axis represents temperature, and the vertical axis represents humidity.

According to temperature and humidity, three different areas are shown, including low-temperature, low-humidity, normal-temperature, normal-humidity, and high-temperature, high-humidity environments. The temperature and humidity at the boundary between the low-temperature, low-humidity environment and the normal-temperature, normal-humidity environment and at the boundary between the normal-temperature, normal-humidity environment and the high-temperature, high-humidity environment are predetermined.

In FIG. 8, temperature and humidity measured by the environmental sensor 41 (see FIG. 2) are plotted with the x mark by way of example.

In the monochrome mode, when the environmental sensor 41 further determines that the temperature and humidity are those in the high-temperature, high-humidity environment as indicated by the x mark in FIG. 8, the control unit 40 controls the motors 43Y, 43M, and 43C and causes the motors 43Y, 43M, and 43C to drive the image holders MY, MM, and MC so that positions at which the three image holders MY, MM, and MC except for the image holder 51K face the developing rolls 81Y, 81M, and 81C are changed temporally. In this driving, when the environmental sensor 41 determines that the temperature and humidity measured fall within the range of the high-temperature, high-humidity environment, the driving may be consistently performed under constant conditions. In the present exemplary embodiment, however, the control in the high-temperature, high-humidity environment is performed under the conditions that are divided as follows.

Specifically, when the temperature and humidity measured are determined to be those in the high-temperature, high-humidity environment, the control unit 40 in the present exemplary embodiment controls the rotation of the three image holders MY, MM, and MC according to the distance d of the environment from another environment at a temperature and humidity lower than those in the high-temperature, high-humidity environment.

The distance d may be calculated by any appropriate method. For example, the distance d may be the humidity or temperature distance d1 vertical from the boundary with the normal-temperature, normal-humidity. Alternatively, when the environment is near the corner of the boundary of the normal-temperature, normal-humidity area, the distance d may be the distance d2 from the corner. Alternatively, a reference point may be determined in the area of the normal-temperature, normal-humidity environment or the low-temperature, low-humidity environment other than the high-temperature, high-humidity environment, and the distance d may be determined from the reference point. FIG. 8 shows that the distance d may be determined to be the distance d3 from the reference point, which is the corner of the boundary between the low-temperature, low-humidity environment and the normal-temperature, normal-humidity environment. In other words, the distance d may be any distance indicating how strongly color streaks can appear.

FIGS. 9A and 9B are diagrams illustrating control according to an environmental distance. FIGS. 9A and 9B show examples where the distance d is calculated by the method of calculating the distance d1 and the distance d2 illustrated in FIG. 8.

Here, FIG. 9A shows how to control in the case of continuous driving. In FIG. 9A, three different conditions $0 \leq d \leq D1$, $D1 \leq d \leq D2$, and $D2 < d$ are set for the distance d, and the three image holders MY, MM, and MC are respectively rotated at rotation speeds of a mm/sec., b mm/sec., and c mm/sec. ($a<b<c$) in the monochrome mode. In this regard, even the highest rotation speed c mm/sec. is much lower than the normal rotation speed during image-forming. Setting the rotation speed as low as possible to prevent the occurrence of color streaks enables power saving and extension of the life of components.

In addition, FIG. 9B shows how to control in the case of intermittent driving. Also in FIG. 9B, three different conditions $0 \leq d \leq D1$, $D1 \leq d \leq D2$, and $D2 < d$ are set for the distance d. In the monochrome mode, the three image holders 51Y, 51M, and 51C are respectively rotated at time intervals of A sec., B sec., and C sec. ($A>B>C$). In this case, the amount of one rotation is set to any small amount that can change the place at which the image holders 51Y, 51M, and 51C face the developing rolls 81Y, 81M, and 81C. Specifically, the image holders 51Y, 51M, and 51C undergoes one rotation only after being intermittently driven a number of times. In this manner, setting the amount of one rotation as small as possible to prevent the occurrence of color streaks enables power saving and extension of the life of components.

In the present exemplary embodiment, there is no need to perform both of the continuous image driving in FIG. 9A and the intermittent driving in FIG. 9B, and any one of these functions may be provided.

In this case, the environmental distance d is calculated and control is performed according to the distance d. Alternatively, regardless of the distance d, constant control may be performed on the basis of the fact that the temperature and humidity measured with the environmental sensor 41 fall within the high-temperature, high-humidity environment range.

Alternatively, constant control may be performed without the environmental sensor 41 or regardless whether the environmental sensor 41 provided determines the high-temperature, high-humidity environment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image holding units that include first and second image holding units and on which toner images are formed through developing while the image holding units rotate;

a plurality of developing units that respectively face the plurality of image holding units and develop an electrostatic latent image on each of the plurality of image holding units with toner under a developing bias voltage applied to each developing unit;

a power supply unit that applies a developing bias voltage to the plurality of developing units, and is common to the plurality of image holding units;

an intermediate transfer unit that receives transfer of a toner image from the plurality of image holding units and transfers the toner image to a transfer receiver while circulating in a circulation path including a moving path along the plurality of image holding units, the intermediate transfer unit having first and second modes, wherein in the first mode, the intermediate transfer unit receives transfer of a toner image from the plurality of image holding units, and in the second mode, the intermediate transfer unit is separated from the second image holding unit other than the first image holding unit and receives transfer of a toner image from the first image holding unit, and a driving unit that drives rotation of the plurality of image holding units; and a measurement unit that measures environmental temperature and humidity, wherein in the second mode, the driving unit drives the second image holding unit so as to temporally change a position at which the second image holding unit faces the developing unit, in the second mode, when the measurement unit determines that the driving unit is in an environment at predetermined high temperature and high humidity, the driving unit drives the second image holding unit so as to temporally change the position at which the second image holding unit faces the developing unit; and in the second mode, when the measurement unit determines that the driving unit is in an environment at predetermined high temperature and high humidity, the driving unit continuously drives the second image holding unit according to an environmental distance between the high-temperature, high-humidity environment and an environment at a temperature and a humidity lower than those of the high-temperature, high-humidity environment in such a manner that the second image holding unit decreases in rotation speed as the distance decreases.

2. The image forming apparatus according to claim 1, wherein in the second mode, the driving unit continuously drives the second image holding unit so as to temporally change the position at which the second image holding unit faces the developing unit.

3. The image forming apparatus according to claim 2, wherein in the second mode, the driving unit continuously drives the second image holding unit at a rotation speed lower than a rotation speed of the first image holding unit.

4. The image forming apparatus according to claim 1, wherein in the second mode, the driving unit intermittently drives the second image holding unit so as to temporally change the position at which the second image holding unit faces the developing unit.

5. The image forming apparatus according to claim 4, wherein in the second mode, the driving unit intermittently drives the second image holding unit in such a manner that the second image holding unit undergoes one rotation when driven a plurality of times.

6. An image forming apparatus comprising:

a plurality of image holding units that include first and second image holding units and on which toner images are formed through developing while the image holding units rotate;

a plurality of developing units that respectively face the plurality of image holding units and develop an electrostatic latent image on each of the plurality of image holding units with toner under a developing bias voltage applied to each developing unit;

a power supply unit that applies a developing bias voltage to the plurality of developing units, and is common to the plurality of image holding units;

an intermediate transfer unit that receives transfer of a toner image from the plurality of image holding units and transfers the toner image to a transfer receiver while circulating in a circulation path including a moving path along the plurality of image holding units, the intermediate transfer unit having first and second modes, wherein in the first mode, the intermediate transfer unit receives transfer of a toner image from the plurality of image holding units, and in the second mode, the intermediate transfer unit is separated from the second image holding unit other than the first image holding unit and receives transfer of a toner image from the first image holding unit;

a driving unit that drives rotation of the plurality of image holding units; and a measurement unit that measures environmental temperature and humidity, wherein in the second mode, the driving unit drives the second image holding unit so as to temporally change a position at which the second image holding unit faces the developing unit, in the second mode, when the measurement unit determines that the driving unit is in an environment at predetermined high temperature and high humidity, the driving unit drives the second image holding unit so as to temporally change the position at which the second image holding unit faces the developing unit, and in the second mode, when the measurement unit determines that the driving unit is in an environment at predetermined high temperature and high humidity, the driving unit intermittently drives the second image holding unit according to an environmental distance between the high-temperature, high-humidity environment and an environment at a temperature and a humidity lower than those of the high-temperature, high-humidity environment in such a manner that the time interval between drives increases as the distance decreases.

* * * * *